US012465191B2

(12) United States Patent
Boyer

(10) Patent No.: US 12,465,191 B2
(45) Date of Patent: Nov. 11, 2025

(54) FILTER CLEANING APPARATUS AND METHOD FOR DISHWASHING APPLIANCE

(71) Applicant: Midea Group Co., Ltd., Foshan (CN)

(72) Inventor: Joel Boyer, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 32 days.

(21) Appl. No.: 18/526,949

(22) Filed: Dec. 1, 2023

(65) Prior Publication Data

US 2025/0176789 A1 Jun. 5, 2025

(51) Int. Cl.
*A47L 15/00* (2006.01)
*A47L 15/42* (2006.01)

(52) U.S. Cl.
CPC ..... *A47L 15/0039* (2013.01); *A47L 15/4208* (2013.01); *A47L 15/4219* (2013.01)

(58) Field of Classification Search
None
See application file for complete search history.

(56) References Cited

U.S. PATENT DOCUMENTS

| | | | |
|---|---|---|---|
| 3,064,661 | A | 11/1962 | Jacobs |
| 4,264,446 | A | 4/1981 | Fregeau |
| 4,678,589 | A | 7/1987 | Ayres, Jr. |
| 4,972,861 | A | 11/1990 | Milocco |
| 5,119,849 | A | 6/1992 | Hinkley |
| 5,667,683 | A | 9/1997 | Benian |
| 5,727,350 | A | 3/1998 | Marcella |
| 6,076,307 | A | 6/2000 | Kean |
| 6,615,853 | B2 | 9/2003 | Hegeman |
| 6,874,641 | B2 | 4/2005 | Clary |
| 6,926,210 | B2 | 8/2005 | Baxter |
| 7,146,992 | B2 | 12/2006 | Elick |
| 7,188,784 | B1 | 3/2007 | Mullins |
| 7,232,494 | B2 | 6/2007 | Rappette |
| 8,540,822 | B2 | 9/2013 | Pyo |
| 9,693,670 | B2 | 7/2017 | Dries |
| 11,805,960 | B2 | 11/2023 | Boyer |
| 2002/0008068 | A1 | 1/2002 | Anderson |

(Continued)

FOREIGN PATENT DOCUMENTS

| | | | |
|---|---|---|---|
| DE | 2822083 | A1 | 11/1979 |
| DE | 102019205919 | A1 | 10/2020 |
| EP | 2213217 | A1 | 8/2010 |

OTHER PUBLICATIONS

Shahinian, Levon J., U.S Patent & Trademark Office; Office Action issued in U.S. Appl. No. 17/210,104; 17 pages; dated Mar. 2, 2023.

(Continued)

*Primary Examiner* — Rita P Adhlakha
(74) *Attorney, Agent, or Firm* — Gray Ice Higdon

(57) ABSTRACT

A dishwashing appliance with a manifold for removing dishwashing sediment from recirculated dishwashing fluid is provided. The dishwashing appliance may include a tub, a spray system, a recirculation pump, a drainage pump, a manifold, and/or a shrouded filtration assembly in fluid communication with the spray system, manifold, the recirculation pump, and/or the drainage pump. The shrouded filtration assembly may include a manifold, a filter frame, and/or a sump housing. The manifold may include one or more sprayers.

17 Claims, 9 Drawing Sheets

(56) References Cited

U.S. PATENT DOCUMENTS

| | | | | |
|---|---|---|---|---|
| 2006/0118146 | A1 | 6/2006 | Jeong et al. | |
| 2006/0237049 | A1 | 10/2006 | Weaver | |
| 2008/0163562 | A1 | 7/2008 | Conant | |
| 2012/0312337 | A1 | 12/2012 | Boyer | |
| 2019/0239715 | A1 | 8/2019 | Thiyagarajan | |
| 2024/0389826 | A1* | 11/2024 | Drexler | A47L 15/4206 |

OTHER PUBLICATIONS

Tang, Jing S., Modelling Study of Dishwasher Hydraulic Filtration System, Proceedings of the World Congress on Engineering and Computer Science, dated Oct. 22, 2019.
Shahinian, Levon J., United States Patent and Trademark Office, Notice of Allowance issued in U.S. Appl. No. 17/210,104, 19 pages, dated Jul. 5, 2023.
Related Applications Transmittal dated Dec. 4, 2023.

* cited by examiner

FILTER CLEANING APPARATUS AND METHOD FOR DISHWASHING APPLIANCE

BACKGROUND

Dishwashing appliances are used in many applications to clean articles such as dishes, silverware, cutlery, cups, glasses, pots, and pans, etc. During wash and rinse cycles, dishwashing appliances typically circulate dishwashing fluid through a dishwashing chamber over those articles to be cleaned or rinsed. The dishwashing fluid may be, e.g., various combinations of water and detergent during the wash cycle (which may include additives) during the rinse cycle. Conventional dishwashing appliances include a recirculation pump and a drainage pump for recirculating and draining the dishwashing fluid respectively within the dishwashing chamber. The recirculation pump feeds the dishwashing fluid to various spray arm assemblies for distribution throughout the dishwashing chamber. The dishwashing fluid is then collected in a sump located at or near the bottom of the dishwashing chamber and pumped back into the dishwashing chamber through, e.g., nozzles in one or more spray arm assemblies and other openings that direct the dishwashing fluid against the articles to be cleaned or rinsed.

Depending upon the level of food debris upon the washing articles, the dishwashing fluid used during the wash and rinse cycles will become contaminated with food debris in the form of particles that are carried with the dishwashing fluid. For many purposes, such as to protect the recirculation pump, it is beneficial to filter the contaminated dishwashing fluid by removing and/or reducing particles from the dishwashing fluid, so that relatively clean dishwashing fluid is supplied to the recirculation pump and applied to the articles in the dishwashing chamber.

Accordingly, a filtration system or assembly, which provides the functionality of retaining the food debris loosened by the dishwashing fluid and draining it away during a drainage cycle by the drainage pump, is a component for a dishwashing appliance. The filtration system in conventional dishwashing appliances typically passes a portion of the recirculated dishwashing fluid through the filters equipped in the system then into the recirculation pump. When the recirculation pump operates at a relatively high flow rate, however, keeping the filtration system clean and unblocked becomes increasingly difficult, especially when large amounts of food debris are suspended in the dishwashing fluid. Existing filtration systems are easily clogged, especially when the filter is located at the inlet of the recirculation pump and/or substantially horizontal.

Therefore, there remains a need in the art to improve the existing filtration systems of dishwashing appliances.

SUMMARY

In some embodiments, a dishwashing appliance may comprise a dishwashing tub defining a dishwashing chamber having a tub floor therein. In various embodiments, the appliance may include a manifold positioned adjacent an opening in the tub floor of the dishwashing chamber. In some embodiments, the manifold may include one or more sprayers. In various embodiments, the appliance may include a filter frame depending downwardly from the manifold. In some embodiments, the filter frame may include an upstream side and a downstream side. In various embodiments, the dishwashing fluid may be filtered inwardly through the filter frame from the upstream side to the downstream side. In some embodiments, the one or more sprayers of the manifold spray outwardly through the filter frame (e.g. opposite to the dishwashing fluid) from the downstream side to the upstream side.

In addition, in some embodiments, the manifold may include a first flow path having at least one first sprayer of the one or more sprayers and/or a second flow path having at least one second sprayer of the one or more sprayers. In various embodiments, at least one first sprayer may be different than at least one second sprayer. In some embodiments, the first flow path and the second flow path may be radially spaced from each other. In various embodiments, the filter frame may include a bottom portion and a top portion, wherein the top portion may be adjacent the manifold and the bottom portion may be distal from the manifold. In some embodiments, at least one first sprayer may be configured to spray through the downstream side to the upstream side of the bottom portion and/or at least one second sprayer may be configured to spray through the downstream side to the upstream side of the top portion. In some embodiments, the appliance may include a spray system having one or more distribution devices within the dishwashing chamber. In various embodiments, a recirculation pump may be configured to flow dishwashing fluid to the spray system and the one or more sprayers of the manifold. In some embodiments, a drainage pump may be configured to flow dishwashing fluid and debris to a drainage pipe. In various embodiments, a sump housing may have an open top portion through which the filter frame may be coupled, and a base portion having a recirculation intake port in fluid communication with the recirculation pump via a recirculation pump inlet port and a recirculation pump outlet port, and a debris collection chamber in fluid communication with the drainage pump and the drainage pipe via a drainage pump port and a drainage port, wherein when dishwashing fluid may be extracted by the recirculation pump through the filter frame to the recirculation pump via the recirculation intake port and the recirculation pump inlet port, and into both the spray system and the one or more sprayers of the manifold via the recirculation pump outlet port therefrom. In various embodiments, the one or more sprayers may be configured to spray debris from the upstream side of the filter frame outwardly towards a debris collection chamber. In some embodiments, the one or more sprayers of the manifold may be downstream of the filter frame.

In some embodiments, a filtration assembly for a dishwashing appliance may include a tub defining a dishwashing chamber having a tub floor. In various embodiments, the filtration assembly may be positioned at the bottom of the dishwashing chamber through an opening formed by the tub floor thereof. In some embodiments, the filtration assembly may include a stationary manifold positioned at the top of the filtration assembly. In various embodiments, the manifold may be positioned above the opening of the tub floor to form a gap therebetween around a periphery of the manifold to allow the dishwashing fluid to flow into the filtration assembly. In some embodiments, the manifold may include one or more sprayers. In various embodiments, the assembly may include a filter frame coupled to the manifold defining a filtration chamber. In some embodiments, the dishwashing fluid may flow through the filter frame into the filtration chamber for filtration. In some embodiments, the dishwashing fluid may flow from the debris collection chamber through the filter frame into the filtration chamber for filtration. In some embodiments, the assembly may include a sump housing having an open top through which the filter frame may be disposed and a base portion having a recirculation intake port in downstream communication with the filtration chamber, and wherein the sump housing defines a debris collection chamber, the dishwashing fluid flows to the debris collection chamber outside the filtration chamber. In various embodiments, the one or more sprayers of the manifold may spray away from the filtration chamber and in a direction upstream of the filtration chamber towards the debris collection chamber.

In addition, in some embodiments, the assembly may include a first flow path having at least one first sprayer of the one or more sprayers and/or a second flow path having at least one second sprayer of the one or more sprayers. In various embodiments, at least one first sprayer may be different than at least one second sprayer. In some embodiments, the first flow path and the second flow path may be radially spaced from each other. In various embodiments, the filter frame may include a bottom portion and a top portion, wherein the top portion may be adjacent the manifold and the bottom portion may be adjacent the recirculation intake port, and wherein at least one first sprayer may be configured to spray through a downstream side to an upstream side of the bottom portion and/or at least one second sprayer may be configured to spray through a downstream side to an upstream side of the top portion. In some embodiments, an outer periphery of the filter frame may be spaced inwardly from an outer periphery of the manifold.

In some embodiments, a method of cleaning a filter frame of a dishwashing appliance may include providing a manifold fixedly coupled to a filter frame, wherein the filter frame may depend downwardly from the manifold, wherein the filter frame may include an upstream side and a downstream side, and/or wherein the manifold may include one or more sprayers positioned within a filtration chamber defined by the manifold and may be adjacent the downstream side of the filter frame. In some embodiments, the method may include filtering dishwashing fluid through the upstream side of the filter frame to the downstream side of the filter frame into the filtration chamber. In various embodiments, the method may include spraying dishwashing fluid from the one or more sprayers of the manifold through the downstream side of the filter frame to the upstream side of the filter frame out of the filtration chamber.

In addition, in some embodiments, the method may include spraying dishwashing fluid radially outward through the downstream side of the filter frame to the upstream side of the filter frame out of the filtration chamber. In some embodiments, the method may include spraying dishwashing fluid radially outward from the filter frame into the debris collection chamber. In various embodiments, the filter frame may include at least a first filter portion above at least a second filter portion. In some embodiments, the method may include spraying at least the second filter portion with a first sprayer of the one or more sprayers and/or spraying at least the first filter portion with a second sprayer of the one or more sprayers different from the first sprayer. In various embodiments, the manifold may include a first path in communication with a first sprayer of the one or more sprayers and/or a second path in communication with a second sprayer of the one or more sprayers. In some embodiments, the manifold may include a second sprayer of the one or more sprayers positioned at a larger radius than a first sprayer of the one or more sprayers in the manifold. In various embodiments, filtering dishwashing fluid may be radially inward from a debris collection chamber through the upstream side of the filter frame to the downstream side of the filter frame into the filtration chamber.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above-outlined features are to be understood as exemplary only, and many more features and objectives of the various embodiments may be gleaned from the disclosure herein. Therefore, no limiting interpretation of this summary is to be understood without further review of the entire specification, claims, and drawings included herewith. A more extensive presentation of features, details, utilities, and advantages of the present disclosure is provided in the following written description of various embodiments of the disclosure, illustrated in the accompanying drawings, and defined in the appended claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosure.

DETAILED DESCRIPTION

Figure 1:
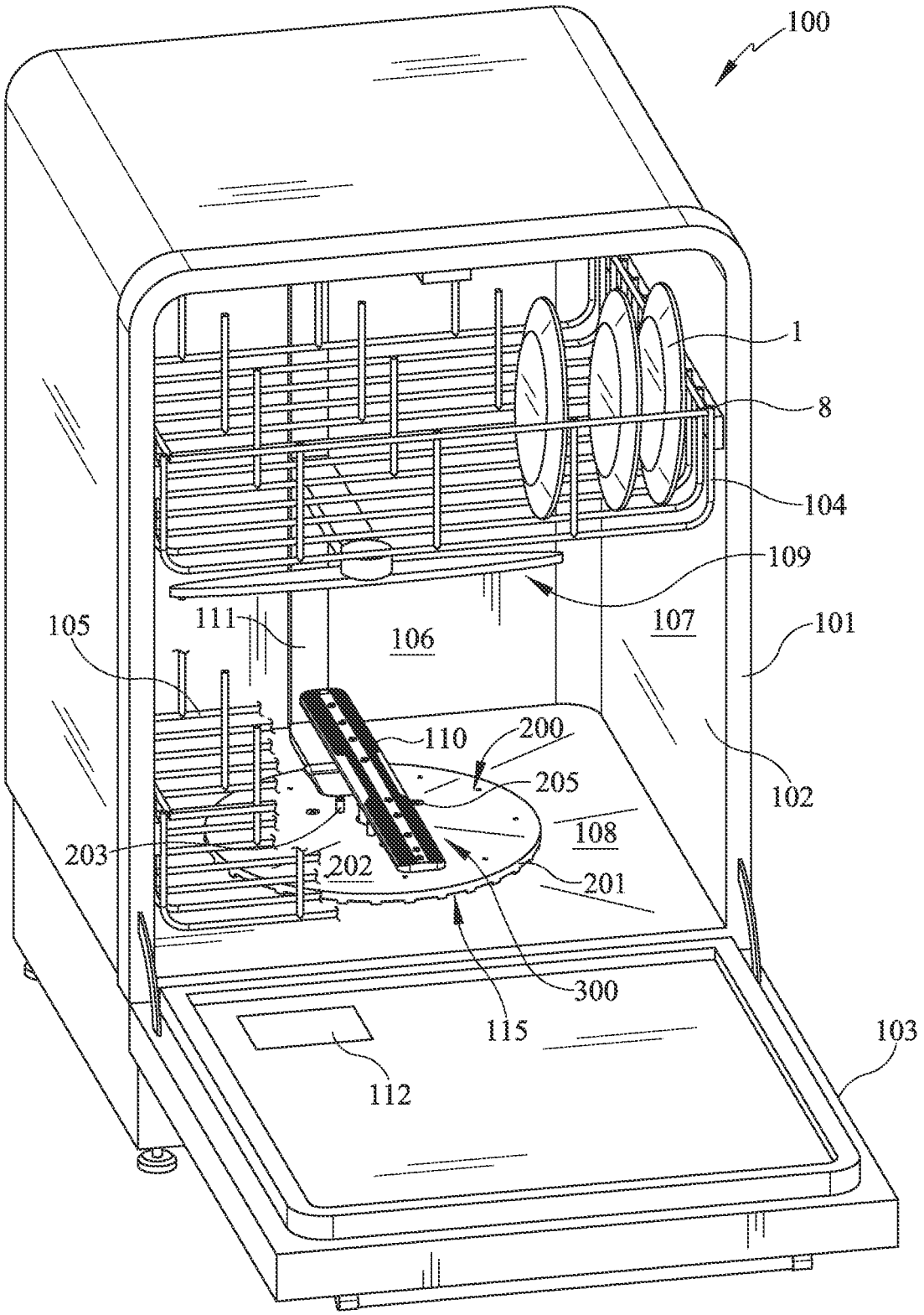
FIG. 1 is a perspective view of a dishwashing appliance with a shrouded filtration assembly and/or manifold, with a front door in a horizontal open position, according to an embodiment of the present disclosure.

It is to be understood that a dishwashing appliance with a shrouded filtration system is not limited in its application to the details of construction and the arrangement of components set forth in the following description or illustrated in the drawings. The described embodiments are capable of other configurations and of being practiced or of being carried out in various ways. Also, it is to be understood that the phraseology and terminology used herein is for the purpose of description and should not be regarded as limiting. The use of "including," "comprising," or "having" and variations thereof is meant to encompass the items listed thereafter and equivalents thereof, as well as additional items. Unless limited otherwise, the terms "connected," "coupled," and "mounted," and variations thereof herein, are used broadly and encompass direct and indirect connections, couplings, and mountings. In addition, the terms "connected" and "coupled" and variations thereof are not restricted to direct physical or mechanical connections or couplings.

The embodiments discussed hereinafter will, for convenience only, focus on the implementation of the hereinafter-described techniques within a residential type dishwashing appliance. However, it should be understood that the techniques may also be used in connection with other types of home appliances in some embodiments. For example, the techniques may be used in a commercial dishwashing application or a washing appliance (e.g., a washer) in some embodiments. Moreover, at least some of the herein-described techniques (e.g., filter cleaning) may be used in connection with other different dishwashing appliance configurations, including dishwashing appliances utilizing filtration systems and/or dishwashing drawers.

Turning now to the drawings, wherein like numbers denote like parts throughout the several views, FIG. 1 is a prospective view of a dishwashing appliance 100 with a shrouded filtration assembly 200 according to an embodiment of the present disclosure. The dishwashing appliance 100 may share many features of a conventional dishwashing appliance and may not be described in detail herein except as necessary for a complete understanding of the disclosure. A dishwashing tub 101 may define a dishwashing chamber 102 having a tub floor 108 therein. As shown in FIG. 1, the dishwashing appliance 100 may include a housing, cabinet, or tub 101, which the interior space thereof may be defined as a dishwashing chamber 102. The dishwashing chamber 102 may be, for example, a stamped metal cavity or an injection molded plastic cavity, with a top wall (not visible in the figures), a rear wall 106, an opposing side wall 107, and a tub floor 108. The top wall, rear wall 106, opposing side wall 107, and the tub floor 108 may be planar elements surrounding the dishwashing chamber 102. The dishwashing chamber 102 may have an open front face that may be accessible by opening a dishwashing door 103 hinged, typically, at its bottom for movement between a normally closed vertical position, wherein the dishwashing chamber 102 is sealed shut for dishwashing cycles, and a horizontal open position for loading and unloading of articles from the dishwashing appliance. The front door 103 may also include a detergent dispenser 112 located on the inner surface thereof for providing detergent to mix with the water for recirculation during wash cycles. Control over the dishwashing appliance 100 by a user may generally be managed through a control panel (not shown) typically disposed on a top or front portion of the front door 103, and it should be understood that in different designs, the control panel may include various types of input and/or output devices, including various knobs, buttons, lights, switches, textual and/or graphical displays, touch screens, etc. through which a user may configure one or more settings and start and stop a dishwashing operation.

In some embodiments, one or more dishwashing racks may be provided within the dishwashing chamber 102. For example, as shown in FIG. 1, an upper dishwashing rack 104 and a lower dishwashing rack 105 may be provided within the dishwashing chamber 102 to receive one or more washable items 1. The upper dishwashing rack 104 may be disposed above the lower dishwashing rack 105 and spaced apart by a predetermined distance. In some embodiments, the upper dishwashing rack 104 and the lower dishwashing rack 105 may be guided by a guide rail 8 provided on opposing side walls 107 of the dishwashing chamber 102, such that the dishwashing racks 104 and 105 may be drawn in and out through the open front face of the dishwashing chamber 102 between loading (extended) and dishwashing (retracted) positions along a substantially horizontal direction. In some embodiments, the lower dishwashing rack 105 may be supported on, for example, rollers, while the upper dishwashing rack 104 being supported by the guide rail 8. It should be understood that the dishwashing racks 104 and 105 may be in any feasible configurations suitable for holding dishes, pans, glasses, cups, utensils, or other washable items 1 that may be treated in the dishwashing chamber 102 without detracting from the disclosure. For example, in some embodiments as shown, the dishwashing racks 104 and 105 may include a plurality of tines to help support the washable items 1. It should be also understood that other particular support apparatus other than dishwashing racks 104 and 105 may be provided within the dishwashing chamber 102 for supporting the washable items 1 to be washed during dishwashing operation.

In some embodiments, the dishwashing appliance 100 may include a spray system for directing the dishwashing fluid into the dishwashing chamber 102 and over the washable items 1. The spray system may include one or more dishwashing fluid sprayers, which may be illustrated in the form of an upper spray arm assembly 109 and a lower spray arm assembly 110 as shown in FIG. 1. The one or more spray arm assemblies 109 and/or 110 may be provided within the dishwashing chamber 102 in a stacked manner and oriented relative to the dishwashing racks 104 and 105 such that the dishwashing fluid sprayed from the spray arm assemblies 109 and 110 may be directed onto the washable items 1 within the dishwashing racks 104 and 105. As shown in FIG. 1, for example, the upper spray arm assembly 109 may be located in an upper region of the dishwashing chamber 102 and in close proximity to the upper dishwashing rack 104, and the lower spray arm assembly 110 may be rotatably mounted at or near the bottom of the dishwashing chamber 102 and above the tub floor 108 so as to rotate in relatively close proximity to the lower dishwashing rack 105. In some embodiments, another top spray arm (not shown in the figures) may be located above the upper dishwashing rack 104. However, this positioning is not intended to be limiting, as various distribution devices may be positioned through the dishwashing chamber 102. In such embodiments as shown in FIG. 1, the upper spray arm assembly 109 below the upper dishwashing rack 104 may provide a dishwashing fluid spray upwardly through the open bottom of the upper dishwashing rack 104, and the lower spray arm assembly 110 below the lower dishwashing rack 105 may respectively provide a dishwashing fluid spray upwardly onto the washable items 1 therein. It should be understood that the upper spray arm assembly 109 may also optionally provide a dishwashing fluid spray downwardly onto the washable items 1 within the lower dishwashing rack 105 thereunderneath. In some embodiments, while the upper spray arm assembly 109 may be, but need not be, a fixed spray arm, the lower spray arm assembly 110 may be, but need not be, a rotational spray arm. It should be understood that the arrangement and/or the configuration of the one or more spray arm assemblies 109 and 110 is not limited to the present disclosure as the description here merely serves for illustration. For example, the dishwashing appliance 100 may alternatively include various combinations of wall-mounted sprayers, rack-mounted sprayers, oscillating sprayers, fixed sprayers, rotating sprayers, and focused sprayers, etc.

Each of the spray arm assemblies 109 and 110 may include an arrangement of discharge ports or orifices for directing the dishwashing fluid onto the washable items 1 located within the dishwashing racks 104 and 105. In some embodiments, the arrangement of the discharge ports in the spray arm assemblies 109 and 110 may provide a rotational force by virtue of the dishwashing fluid flowing through the discharge ports. The resultant rotation of the spray arm assemblies 109 and 110 may then provide coverage of the washable items 1 with a spray of the dishwashing fluid. The dishwashing fluid for the spray arm assemblies 109 and 110 may be fed by a recirculation pump for circulating the dishwashing fluid within the dishwashing chamber 102, and the one or more spray arm assemblies 109 and 110 may be supplied by respective conduits. For example, in some embodiments, the dishwashing fluid for the upper spray arm assembly 109 may be fed through an upper spray arm supply conduit 111 extending upwardly along the rear wall 106. While not described in detail herein, the conduits may be hoses, pipes, tubes, or the like as would be understood in the art. In some embodiments, a heater (not shown) may heat the dishwashing fluid supplied to various temperatures, thereby improving dishwashing efficiency and performance.

In some embodiments as best shown in FIGS. 1-6, the appliance 100 and/or the tub floor 108 may include a recess 113 and/or an opening 114 over which a filtration assembly 200 (e.g. manifold), or portions thereof, may be removably received. In some embodiments, the recess 113 may be downwardly sloped toward the bottom of the dishwashing appliance 100 so that the dishwashing fluid sprayed from the spray system is collected in and directed toward the filtration assembly 200 for filtering and re-circulation during dishwashing operation. The object of providing the filtration assembly 200 is to remove food debris from the used dishwashing fluid before the dishwashing fluid is recirculated and once again is sprayed into the dishwashing chamber 102. The filtration assembly 200 may improve the final dishwashing result and ensure the function of the recirculation system (e.g., a recirculation pump) that otherwise could get blocked by the food debris contained in the dishwashing fluid.

Figure 2:
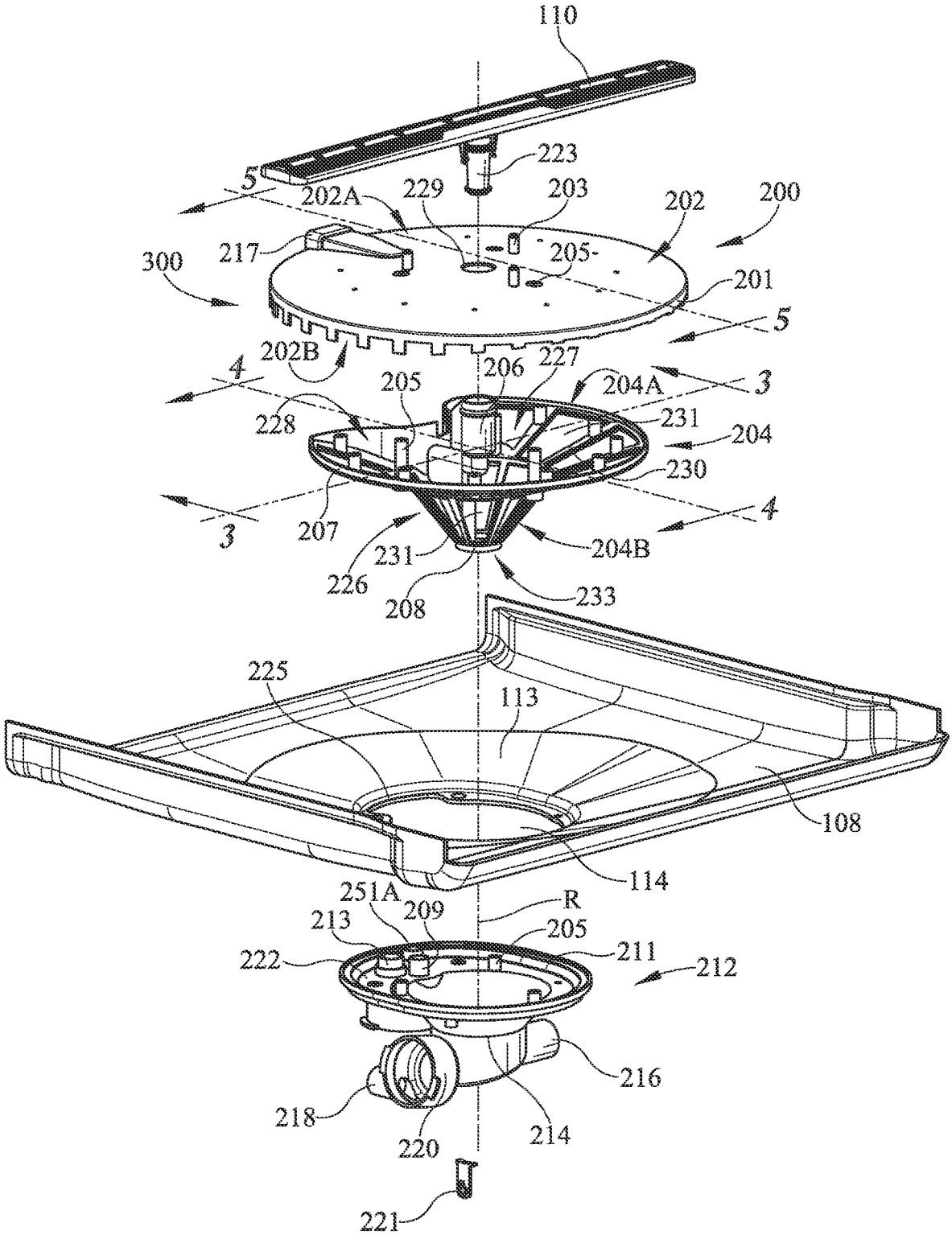
FIG. 2 is a perspective exploded view of the interior of the shrouded filtration assembly of FIG. 1, according to an embodiment of the present disclosure.
Figure 3:
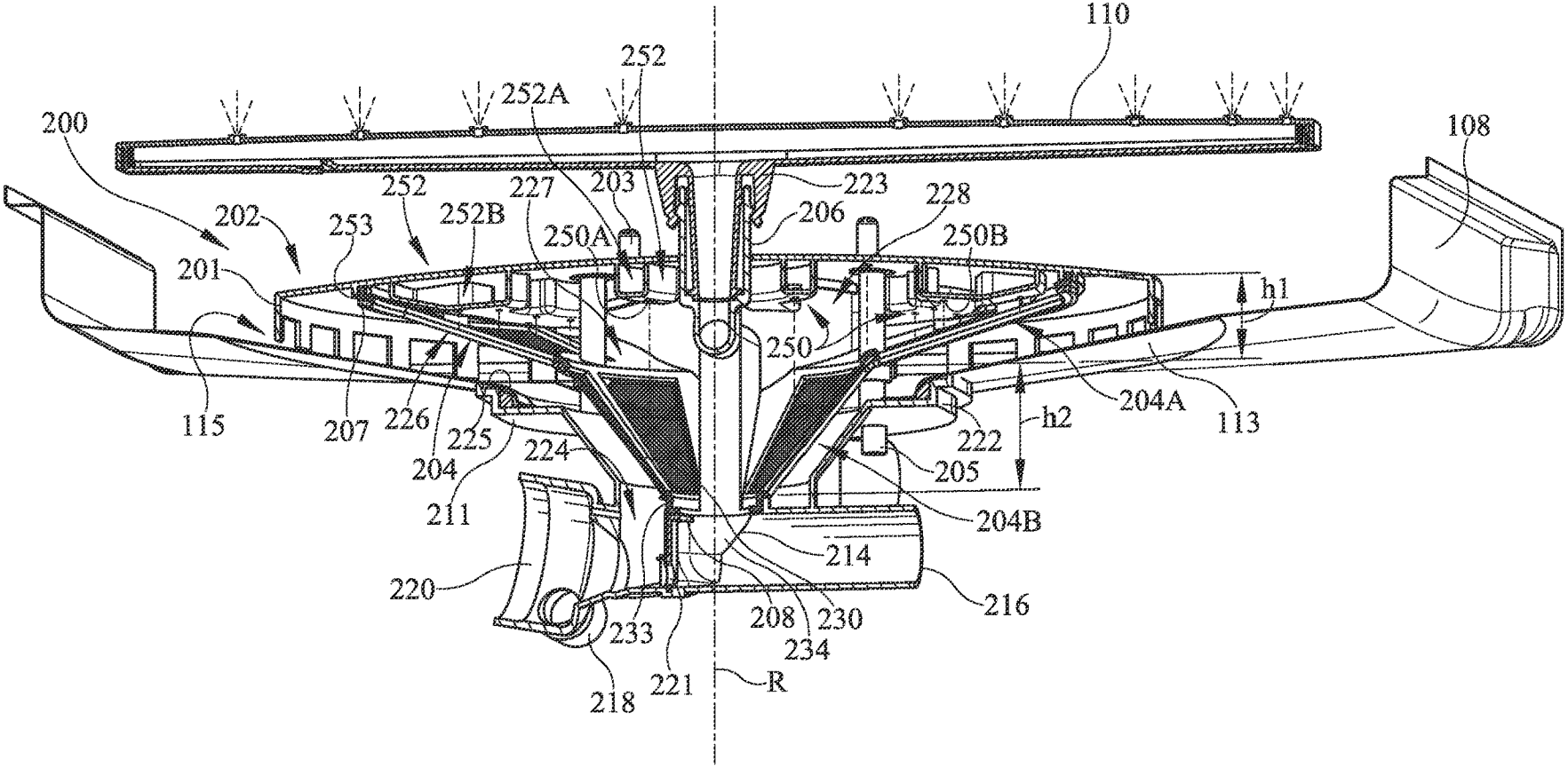
FIG. 3 is a sectional view of the shrouded filtration assembly of FIG. 2 taken along line 3-3, according to an embodiment of the present disclosure.
Figure 4:
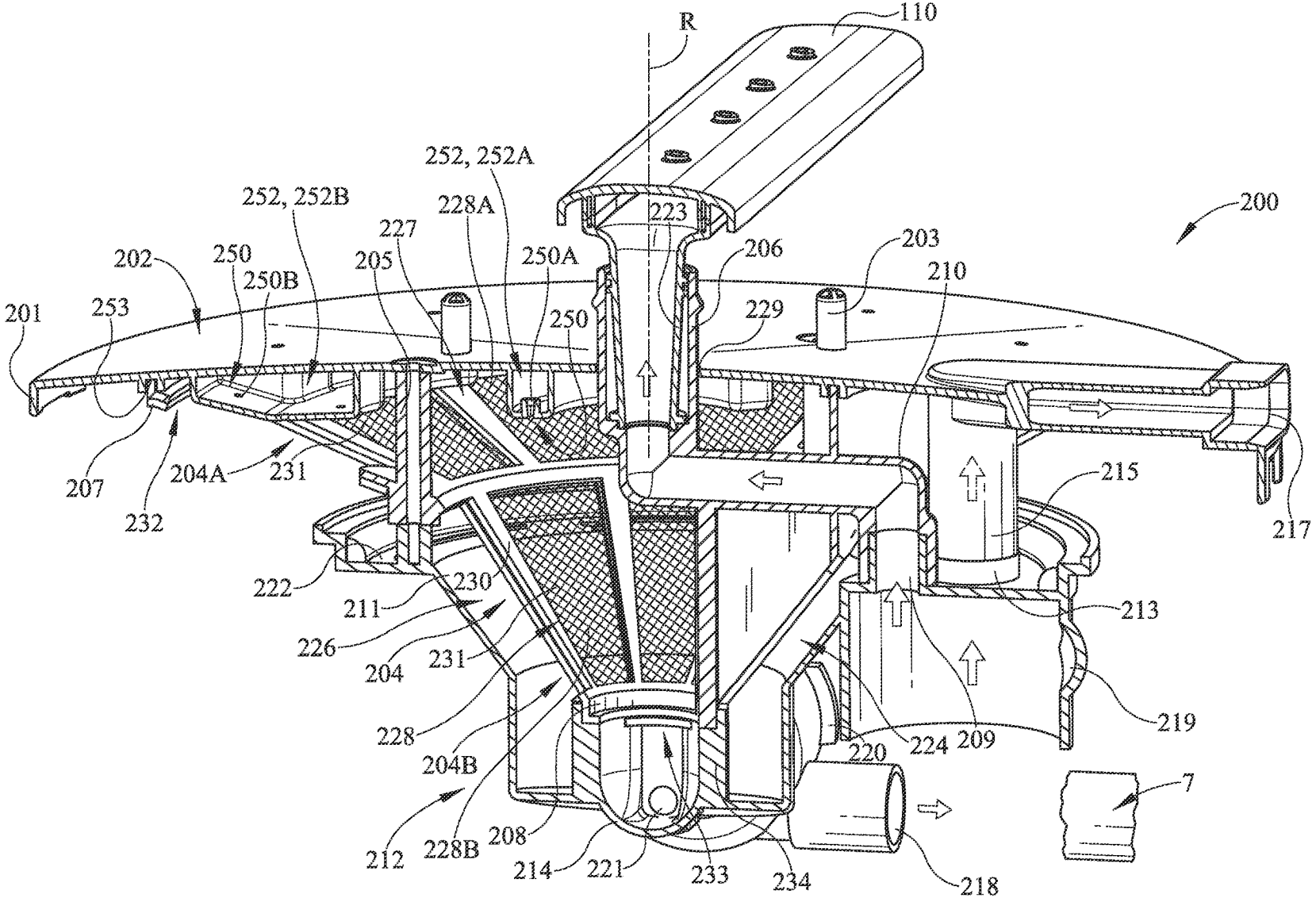
FIG. 4 is another sectional view of the shrouded filtration assembly of FIG. 2 taken along line 4-4, according to an embodiment of the present disclosure.
Figure 5:
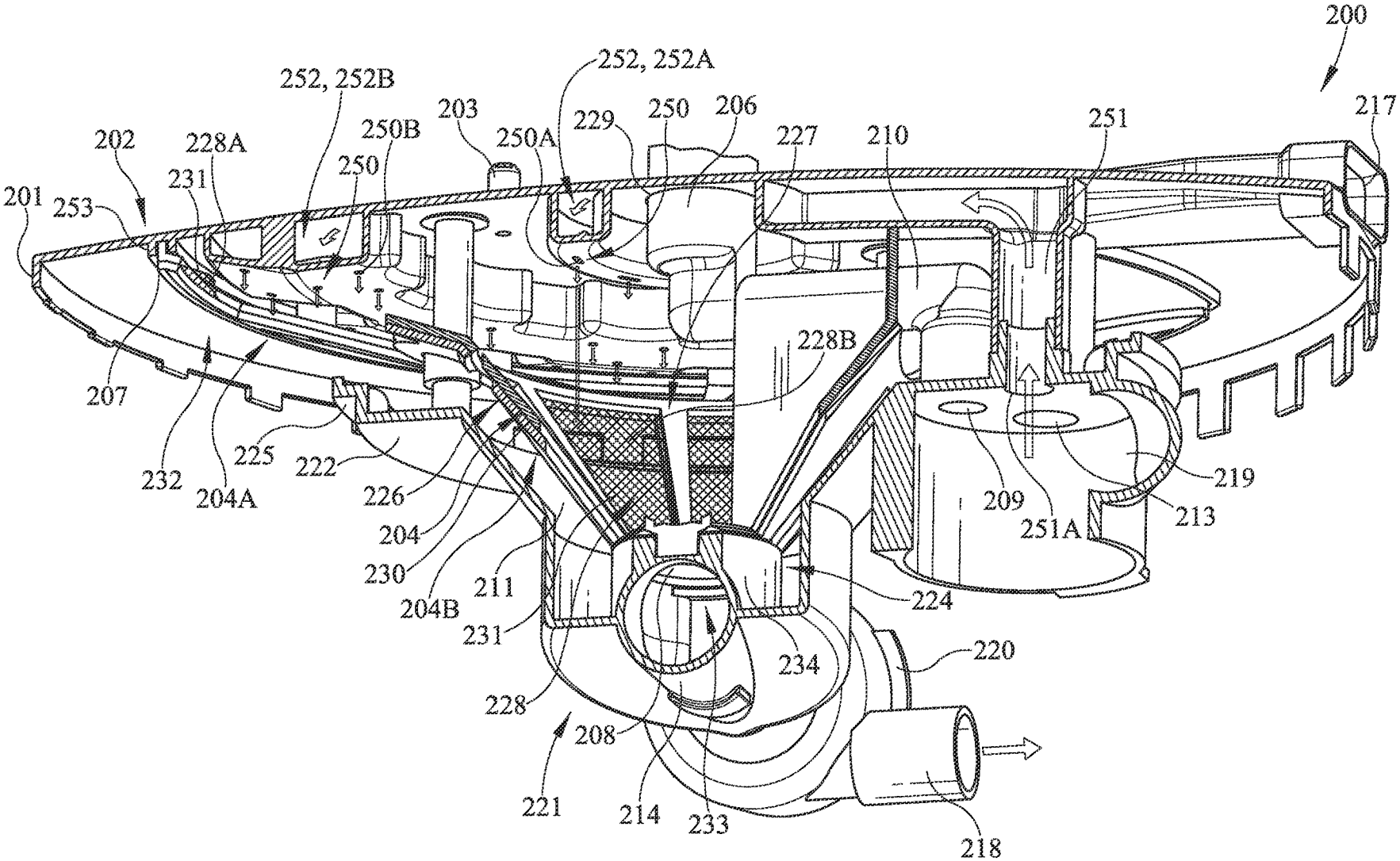
FIG. 5 is another sectional view of the shrouded filtration assembly of FIG. 2 taken along line 5-5, according to an embodiment of the present disclosure.

Referring to FIG. 2, an exploded view of the shrouded type filtration assembly 200 in accordance with some embodiments of the present disclosure is illustrated. FIGS. 3-5 are sectional views of FIG. 2. In some embodiments as shown, the filtration assembly 200 may include a lid/manifold 202, a filter frame 204, and/or a sump housing 212, and the filtration assembly 200 may be configured to provide dishwashing fluid (e.g. filtered) for recirculation in the dishwashing chamber 102. As shown in the one embodiment, the manifold 202 is stationary/fixed (e.g. does not rotate) relative to remaining portion of the assembly 200 (e.g. filter, sump housing) or appliance 100 (e.g. tub floor, chamber). In some embodiments, the manifold 202 may include a first (upper) side 202A and a second (bottom) side 202B and be generally circular in shape with a closed (e.g. upper side) and impermeable surface body to prevent the dishwashing fluid from entering the filtration assembly 200 directly through the manifold 202. In order to achieve a durable sealing effect to prevent the dishwashing fluid from flowing through the manifold 202, different materials and/or material combinations may be used, such as plastic or rubber coating on one or both of the first and second sides 202A and 202B. In some embodiments, the first side 202A of the manifold 202 may also be downwardly sloped to aid the dishwashing fluid sprayed from the spray system to be directed toward the filtration assembly 200 for filtration and recirculation, as will be described below.

In some embodiments, the manifold 202 may be positioned at a top of the filtration assembly 200 and above the recess 113 and/or opening 114 of the tub floor 108 to form a gap 115 therebetween around a periphery 201 of the manifold 202 as best shown in FIG. 1. The manifold 202 may be positioned within or adjacent the opening 114 in the tub floor 108. With such an arrangement, the dishwashing fluid that has circulated through the dishwashing chamber 102 may flow into the filtration assembly 200 through the gap 115, opening 114, and/or flow down along the sloped surface of the recess 113 towards the sump housing 212/filter frame 204. The opening size of the gap 115 may be configured to prevent larger items from entering the filtration assembly 200, such as a piece of silverware or another washable item 1 that is dropped from the rack assemblies 104 and 105.

In some embodiments, the filter frame 204 may be coupled (e.g. fixed) to the manifold 202 (e.g. second or bottom side 202B) and configured to define a filtration chamber 228 positioned within the interior space of the filter frame 204, or more particularly, between a top end 232 and a bottom end 233 of the filter frame 204. The filter frame 204 may depend from or project downwardly from the manifold 202. The manifold 202 may close the top end 232 of the filter frame 204. In some embodiments, the planes of the top end 232 and the bottom end 233 may be parallel to each other. For mechanical filtration, the removal of soil particles of different sizes is typically achieved by providing fluid paths (such as pores or apertures) through the filter (e.g. a filter screen or filter media) that are smaller than the particles for which filtration is desired. Particles having a dimension larger than the size of the fluid paths will be trapped to be prevented from passing through the filter screen while particles smaller than the size of the fluid path will generally be able to pass through. For example, a coarse filter may be employed on the filter frame 204 to retain large soil particles, while a fine filter may be utilized to remove smaller particles. Some particle sizes and/or types may not be harmful to the pump, manifold, and/or spray arm assemblies and, therefore, may be allowed to pass into the recirculation pump system. Accordingly, the filter frame 204 may be configured for attaching one or more filter screens (e.g., 228A-B) thereon through which the dishwashing fluid flows into the filtration chamber 228 for filtration. More particularly, for the embodiment depicted, the filter frame 204 may include a plurality of pillars/members 230 extending approximately along the vertical axis R from the top end 232 to the bottom end 233 with a plurality of filtration windows 231 defined therebetween. The one or more filter screens (e.g., the filter screens 228A-B as shown schematically in FIG. 6) may cover the plurality of filtration windows 231. It should be appreciated, however, that in other exemplary embodiments, the filter frame 204 may instead include any other suitable filter mediums as well as any other suitable support structure. The dishwashing sediment in the form of food debris, soil, and/or particles may then be filtered and separated from the dishwashing fluid as it passes through the one or more filter screens (e.g. from the upstream side to the downstream side, filter) to proceed into a debris collection chamber 224 as will be described below. Sediment may accumulate on the upstream side of the filter frame 204 and/or be subsequently sprayed (e.g. one or more pulses of spray, backflush) from the manifold in a reverse flow direction to dislodge the accumulated debris on the upstream side of the filter frame 204.

In some embodiments, the appliance 100, manifold 202, and/or filtration assembly 200 may include the sump housing 212 located in the lower part thereof for collecting residual dishwashing fluid from the dishwashing chamber 102 and the dishwashing sediment contained. The sump housing 212 may include an open top portion 211 and a base portion 214, and the open top portion 211 may be configured for receiving the filter frame 204 therethrough. In some embodiments, the top portion 211 of the sump housing 212 may include a flange portion 222 for accommodating various components, such as fastening elements 205 and/or one or more flow pathways as will be described below. In some embodiments, the flange portion 222 of the sump housing 212 may be coupled to the tub floor 108 via a flange of the recess 225 as shown in FIG. 2. In some embodiments, the interior shape of the sump housing 212 may be generally circular; however, as should be understood, the shape and depth of the sump housing 212 are not limited thereto. Rather, the sump housing 212 may have various shapes and depths so long as the sump accommodates and effectively collects the required volume of dishwashing fluid used during operation.

Figure 6:
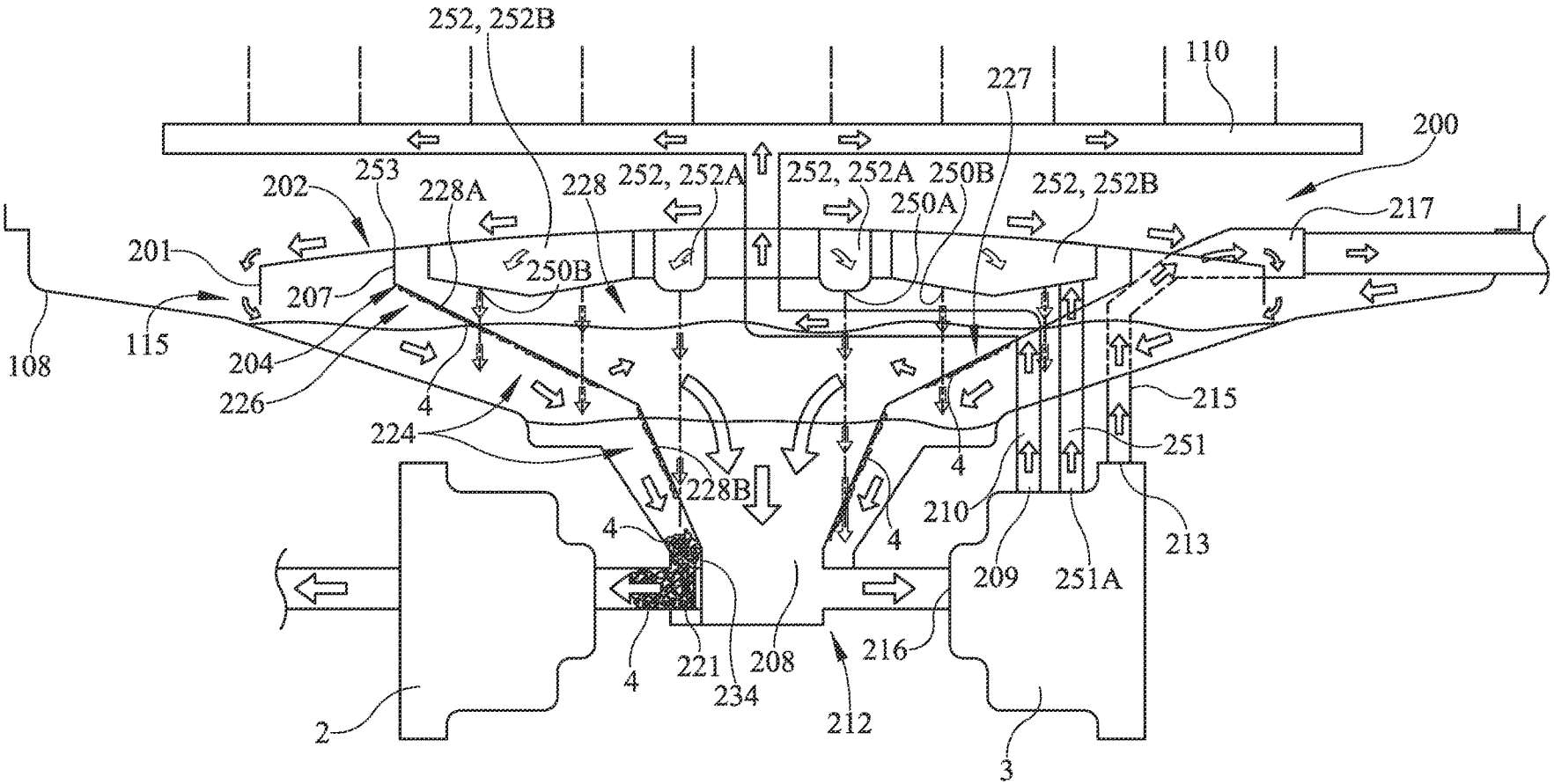
FIG. 6 is a schematic side view of a shrouded filtration assembly and/or manifold, according to various embodiments of the present disclosure.
Figure 7:
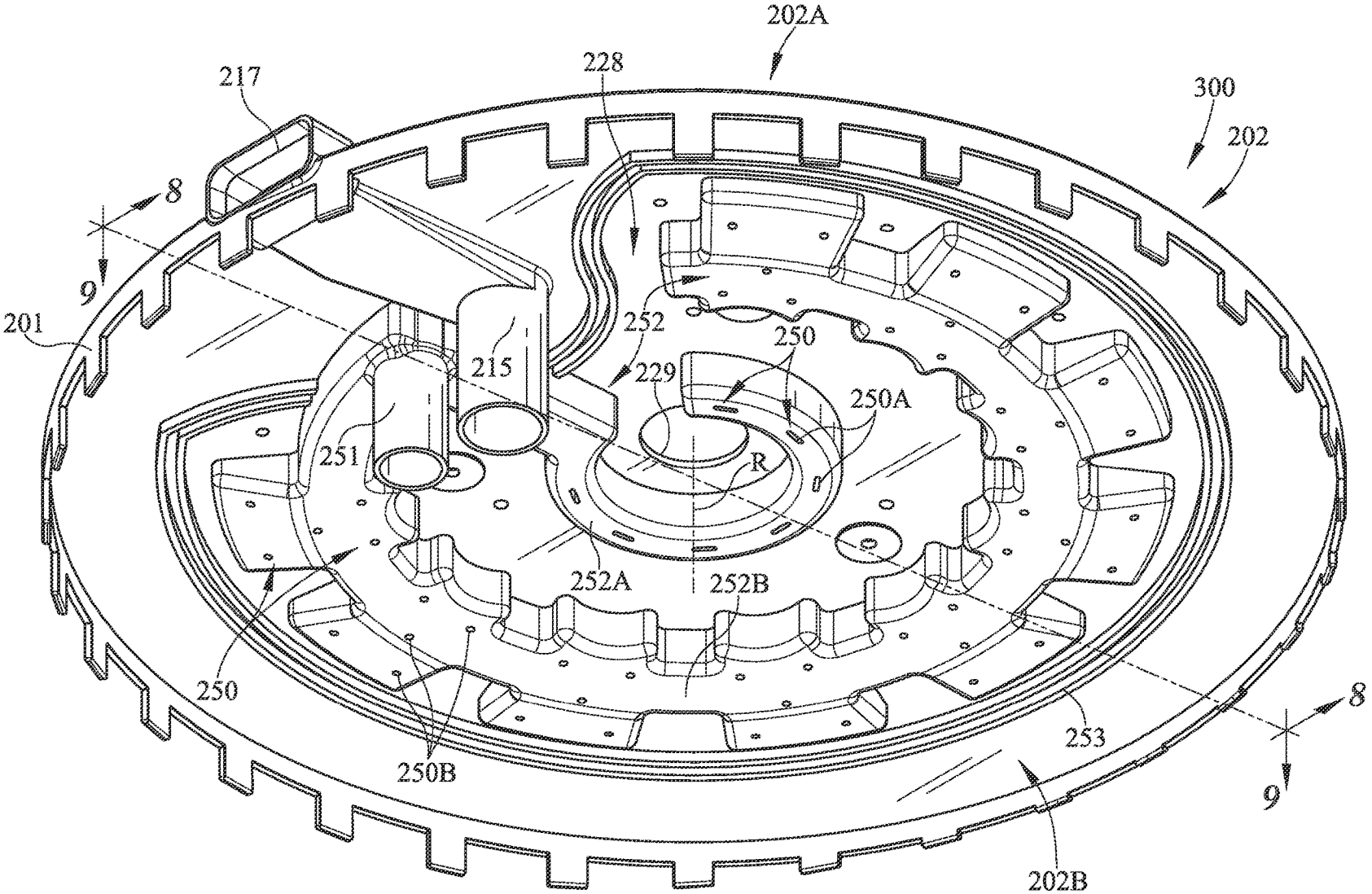
FIG. 7 is a bottom perspective view of the manifold of FIG. 1, according to an embodiment of the present disclosure.

A recirculation pump 3 (as shown in FIG. 6) may be situated level with, or below the base portion 214 of the sump housing 212, and a recirculation pump inlet port 216 with atmospheric pressure may be positioned at a side of the base portion 214 of the sump housing 212 to supply filtered dishwashing fluid to the recirculation pump 3. The dishwashing fluid may be extracted by the recirculation pump 3 through the filter frame 204 to the recirculation pump 3 via the recirculation intake port 208 and the recirculation pump inlet port 216. An opening may be arranged at the base portion 214 to be a recirculation intake port 208, and the dishwashing fluid collected in the filtration assembly 200 may flow to the recirculation pump 3 through the recirculation intake port 208 and the recirculation pump inlet port 216 due to the suction force generated by the recirculation pump 3. In some embodiments, the recirculation intake port 208 may be an opening formed and projected from the bottom end 233 of the filter frame 204 as best shown in FIGS. 2-5. In some embodiments, a recirculation pump outlet port 219, which is pressurized, may be configured to discharge the filtered, recirculated dishwashing fluid from the recirculation pump 3 to the spray arm system including one or more distribution devices, such as the spray arm assemblies 109 and 110 and/or the manifold 202, of portions thereof (e.g. sprayers, pathways, supply conduits, channels, discharge ports, orifice(s)).

Additionally, a drainage pump 2 (as shown in FIG. 6) may be provided at a drainage pump port 220 and in fluid communication with a debris collection chamber 224 located at the bottom of the sump housing 212 of the filtration assembly 200 and a drainage port 218. The debris collection chamber 224 provides a volume for receiving and temporarily holding solid dishwashing sediment filtered apart from the recirculated dishwashing fluid during the wash cycle. The debris collection chamber 224 may be positioned outside or external to the filtration chamber 228, filter frame 204 (e.g. upstream side of filter), and/or manifold 202. In some embodiments, the debris collection chamber 224 may be an angled trough (e.g. between filter frame (e.g. upstream side) and the sump housing 212) extending around the filtration chamber 228 (e.g. an outer perimeter 234 of the recirculation intake port 208) as shown in FIGS. 2-6.

As best shown in FIG. 6, the drainage pump 2 may be configured to pump dishwashing sediment or debris 4 accumulated in the debris collection chamber 224, flow/debris away from or outside the filtration chamber (e.g. upstream side), and/or debris 4 sprayed away from the filter frame 204 (e.g. upstream side, from the downstream side to the upstream side, through the filter mesh) from the manifold 202 (e.g. sprayers) to the drainage port 218/base portion 214 and ultimately to a building plumbing system drainage pipe 7 (as shown in FIG. 4), with a negative pressure created at the drainage port 218 when the drainage pump 2 is energized. In some embodiments, the drainage pump 2 may be positioned between the debris collection chamber 224 and the drainage port 218 to generate a suction force to force the dishwashing fluid and the dishwashing sediment to the drainage port 218. A pump motor (not shown) may be electrically connected to a motor controller (not shown) that controls the drainage pump 2 and the recirculation pump 3 respectively to achieve desired dishwashing cycle sequences during operation of the dishwashing appliance 100.

As best shown in FIG. 2, the filtration assembly 200 and/or manifold 202 may include one or more fasteners 205 (e.g., rivets, pins, screws, bolts, nuts, clips, flanges, or other hardware items) to couple the different components (e.g., the manifold 202, the filter frame 204, and the sump housing 212, etc.) together. In some embodiments as shown, the one or more fasteners 205 may be pin-slot mechanisms for integrally coupling the manifold 202 and the sump housing 212 to the filter frame 204. It should be understood that other suitable coupling methods (e.g., hook-and-loop fasteners, snaps, riveting, adhesive, or the like) may also be acceptable here. In such a manner, the filtration assembly 200 may be easily assembled and disassembled for components change/replacement/clean in both a quick and easy manner. In some embodiments, one or more sealing members (e.g., elastomer O-rings) may be positioned to fit against different components of filtration assembly 200 wherein the different components are integrally disposed adjacent to one another, to further seal off the dishwashing fluid flow.

Accordingly, during operation of the dishwashing appliance 100, with the recirculation pump 3 operating, the dishwashing fluid stored in the sump housing 212 of the filtration assembly 200 may be simultaneously or selectively directed to the upper spray arm assembly 109, manifold 202, and/or the lower spray arm assembly 110. The dishwashing fluid may be provided with a dishwashing agent dispensed from the detergent dispenser 112 to wash the washable items 1 received in the racks 104 and 105 within the dishwashing chamber 102. The dishwashing fluid circulates through the dishwashing chamber 102, flowing into the filtration assembly 200 (e.g. filter frame) through the gap 115 formed around the periphery 201 of the manifold 202, through the one or more filter screens (e.g. upstream side to the downstream side) into the filtration chamber 228 for flirtation, then into the recirculation pump 3 via the recirculation intake port 208 and the recirculation pump inlet port 216 as best shown in FIG. 3, then through the recirculation pump outlet port 219 back to the spray system and/or manifold (e.g. without passing through the debris collection chamber). Meanwhile, most of the dishwashing sediment, such as food debris, contained in the recirculated dishwashing fluid may proceed into the debris collection chamber 224 located at the bottom of the sump housing 212 directly by gravity, without first going through coarse filters typically required in conventional filtration systems for dishwashing appliances. Thus, with such a configuration of the filtration assembly 200, most of the dishwashing sediment in the dishwashing fluid may be filtered from the dishwashing fluid without having to pass through the one or more filter screens. In some embodiments, the non-filtered dishwashing fluid flow bypasses the filter frame/filtration chamber into the debris collection chamber. This may greatly alleviate the potential filter clogging problems, thereby improving dishwashing efficiency and performance. In some embodiments, the sediment 4 (e.g. clogging the filter) caught by the filter frame 204 and/or upstream side of the filter frame/mesh may be backwashed or sprayed towards the bottom of the sump housing 212 and/or debris collection chamber 224 via the manifold 202 (e.g. sprayers).

In some embodiments, the filter frame 204 may include one or more flow paths in fluid communication with the spray system, manifold, and the recirculation pump. For example, in some embodiments, a flow pathway including a first lower spray arm connection element 206 and a second lower spray arm connection element 223 may extend beneath the lower spray arm assembly 110 and is in fluid communication with the filtration system to supply dishwashing fluid to the lower spray arm assembly 110. The first lower spray arm connection element 206 may be provided on the filter frame 204, and the second lower spray arm connection element 223 may be provided on the lower arm assembly 110. Further, the filter frame 204 may include a filter frame flow path inlet port 210 in fluid communication with the first lower spray arm connection element 206 and a first sump housing flow path 209 located on the sump housing 212 to channel the recirculated dishwashing fluid from the filtration assembly 200 to the lower spray arm assembly 110.

In such embodiments, the manifold 202 may include an opening 229 for at least a portion of the flow paths built in the filter frame 204 (e.g., the flow path formed by coupling the first lower spray arm connection element 206 and the second lower spray arm connection element 223 together). The coupling mechanism between the first lower spray arm connection element 206 and the second lower spray arm connection element 223 may be configured to prevent the dishwashing fluid from entering the filtration assembly 200 through the opening 229, if used. In some embodiments, the manifold 202 may also include one or more flow paths in fluid communication with the spray system. For example, as shown in FIGS. 2-9, the manifold 202 may include a manifold flow path inlet 215 and/or an upper spray arm supply path inlet 217 to the upper spray arm 109 through the upper spray arm supply path 111. In some embodiments, the manifold flow path inlet 215 may be coupled to the second sump housing flow path 213 located on the sump housing 212 to channel the recirculated dishwashing fluid from the filtration assembly 200 to the upper spray arm assembly 109. In some embodiments, the manifold 202 may also include one or more flow paths in fluid communication with the manifold, or portions thereof (e.g. sprayer(s)). For example, as shown in FIGS. 5-9, a manifold flow path inlet 251 may be connected to one or more downstream flow channels 252 and/or sprayer(s) 250 of the manifold. In some embodiments, the manifold flow path inlet 251 may be coupled to a third sump housing flow path 251A located on the sump housing 212 to channel the recirculated dishwashing fluid from the filtration assembly 200 to the manifold 202. The manifold flow path inlet 251 may be coupled to the sump housing 212 (e.g. third sump housing flow path 251A). The manifold flow path inlet 251 may be fluidly coupled with the manifold flow path inlet 215, the second sump housing flow path 213, the filter frame flow path inlet port 210, and/or the first sump housing flow path 209.

In some embodiments, the manifold 202 may include one or more air vents 203 for venting of the filtration chamber 228 during dishwashing operation. As the lower spray arm 110 may extend upwardly from the geometric center (e.g., through the opening 229) of the manifold 202 in some embodiments, the air vents, if used, described herein may be located off-center of the manifold 202 and/or between flow channels so that air in the filtration chamber 228 is more effectively released. Without the one or more air vents 203, an air bubble could form underneath the manifold 202 and prevent the filtration assembly 200 from operating correctly.

The filtration assembly 200 and/or manifold 202, or portions thereof, (e.g. manifold 202, the filter frame 204, and the sump housing 212) may be made either of sheet-metal or a plastic material that are able to withstand the changing temperatures in the dishwashing chamber 102 without deforming. It should be understood that the specific design of the filtration assembly 200 and/or manifold 202 may vary depending on the size and use of the dishwashing appliance 100. For example, the size of the filter frame 204 may be adapted to ensure the desired filtering capacity for the specific dishwashing appliance 100 it is intended to be fitted in. It should also be appreciated, however, that in some other embodiments, the filtration assembly 200 and/or manifold 202 may have any other suitable configurations different from the description herein. For example, the recirculation intake port 208 and/or the recirculation pump inlet port 216 may be positioned at any other suitable locations within the filtration assembly 200.

In some embodiments as shown in figures, the assembly 200, manifold 202, and/or filter frame 204 may include an approximate cone-shaped frame structure around a vertical axis R with the bottom end 233 of the filter frame 204 in a substantially circular shape to aid in channeling the flow of dishwashing fluid across one or more filter screens thereon. It should be appreciated that the shape and/or configuration of the filter frame 204 is not limited thereto. The filter frame bottom end 233 could however also have other shapes like for example oval, rectangular, or triangular. For example, if the bottom end 233 is in a substantially circular or oval shape, the shape of the filter frame 204 could correspond to a section of a sphere, in other words have a shape of a cup with a curved filter surface. In some other embodiments, the shape of the filter frame 204 may be an approximate pyramid with a base corresponding to the shape (e.g., square) of the bottom end 233. In some embodiments, the filter frame 204 may be configured to include an accordion-like cross section for increasing the presented filtration area.

In such embodiments, the filter frame 204, assembly 200, and/or manifold 202 may integrally include a plurality of distinct openings/portions at different levels thereof such that different sized dishwashing sediment are collected at varying locations. For example, the filter frame 204 may include a top portion 204A with openings and a bottom portion 204B with openings in some embodiments as shown in FIGS. 2-6. In such embodiments, the top and bottom portions 204A and 204B may extend in different angles (e.g., any degrees between 0 and 90 degrees) between the manifold 202 (e.g. second side 202B) and the bottom end 233, generally sloping downwardly and inwardly from the top portion 204A, manifold 202, outer periphery 201 to the bottom end 233 so that dishwashing fluid and/or the sediment may be more easily urged into the sump housing 212 and/or the debris collection chamber 224. The top portion 204A may be substantially at the same level with the top end 232 of the filter frame 204 and/or manifold 202. Further, the top portion 204A may be more horizontal than the bottom portion 204B in some embodiments. In some embodiments, the top portion may be at a larger radius than the bottom portion. In some embodiments, the top portion 204A may include a filter frame periphery 207, which may be tightly coupled with the manifold 202 (e.g. bottom side, periphery) to avoid fluid leakage. The filter frame periphery 207 and/or top end 232 may engage or be coupled to the bottom side 202B at one or more engagements. As shown in the one embodiment, the filter frame periphery 207 may be spaced inwardly from the outer periphery 201 of the manifold 202. Although a variety of engagements and positions may be used, the engagements as shown in the one embodiment may be a channel or groove 253. The groove 253 may be spaced inwardly (e.g. radially) from the outer periphery 201 of the manifold 202. The groove 253 may receive the periphery 207 or top end 232 of the filter frame 204. In some embodiments, the surface of the top portion 204A may extend in 45 degrees from the vertical axis R, while the surface of the bottom portion 204B may extend in 80 degrees from the vertical axis R. In detail, a vertical height of the top portion 204A from the manifold 202 to the bottom of the top portion 204A may be defined as h1, and another vertical height from the bottom end 233 to the top of the bottom portion 204B may be defined as h2. In some embodiments as best shown in FIG. 3, the h1 may be smaller than h2.

Further in such embodiments, each of the plurality of portions of the filter frame 204, assembly 200, and/or manifold 202 may be integrally coupled with a filter screen having a certain filtering permeability. In some embodiments, the filtering permeability may be defined by a plurality of openings with a certain maximum allowable size (i.e., a certain filtering permeability) provided on a filter screen to allow the dishwashing fluid to pass through into the filtration chamber 228, while preventing the dishwashing sediment greater than the maximum allowable size of the openings from passing through. Thus, the filter screen may prevent such sizes of dishwashing sediment from flowing into, e.g., the recirculation pump, the spray system, and/or manifold. In such embodiments, the maximum allowable size or the filtering permeability may correspond to a maximum size of dishwashing sediment the recirculation pump, manifold, and/or the spray system can accommodate. In some embodiments, the top portion 204A may be provided with a first filter screen 228A with a first filtering permeability that filters relatively large dishwashing sediment from the dishwashing fluid (e.g., a coarse filter screen), while the bottom portion 204B may be provided with a second filter screen 228B with a second filtering permeability that filters relatively fine dishwashing sediment from the dishwashing fluid (e.g., a fine filter screen). In other words, in such embodiments, the first filtering permeability may be greater than the second filtering permeability. Still in other words, for the embodiment depicted, the second filter screen 228B may be configured to filter dishwashing sediment smaller than the plurality of openings in the first filter screen 228A. Accordingly, the filter screens 228A-B may be configured to filter out dishwashing sediment (e.g., food debris) that has been washed from the debris-laden washable items 1 and that is larger than the individual openings in the filter screens 228A-B. The smaller the openings in the filter screen, the larger the volume of dishwashing sediment that will be filtered from the contaminated dishwashing fluid, and vice versa.

In some embodiments, the filter screens 228A-B may include a mesh wire or plastic screen that is affixed over the filter frame 204. The filter screen 228A-B may also be designed to have a considerably large screen area size to ensure the desired filtration capacity even though parts thereof are blocked by collected sediment particles and dirt. In some embodiments, the filter screens 228A-B may have a substantially constant thickness, but the filter screens 228A-B may be modified in a number of different ways without departing from the scope of the disclosure. In some embodiments, the entire filter frame 204 may be made of a filtering material similar to the filter screens 228A-B in order to maximize the filtering area, alternatively, only the filter screens 228A-B are made of a filtering material.

FIG. 6 is a functional schematic of the filtration assembly 200, filter frame 204, manifold 202, and/or appliance 100 as described above to better illustrate the advantages with the disclosed configuration. As discussed previously, the filter screens 228A-B may get clogged, particularly in the prewash cycle when a large amount of loose dishwashing sediment is falling into the debris collection chamber 224 and accumulate therein. More dishwashing sediment could also come down from the washable item 1 when the dishwashing cycle starts. As fluid passes through the filter screens 228A-B of filter frame 204, the dishwashing sediment 4 may be blocked by the openings thereof and accumulate on the exterior surface or upstream side of the filter screens 228A-B and/or frame 204 and deleteriously affect the filtration efficiency by blocking the openings. For example, as shown in FIG. 6, with a large amount of the dishwashing sediment 4 accumulated in the debris collection chamber 224, and if the accumulation cannot be removed quickly, the filter's clean surface of the second filter screen 228B area may reduce and eventually reach a critical value at which the dishwashing fluid through flow rate becomes lower than that required by the recirculation pump 3. For conventional filtration systems with a fine filter screen prior to the dishwashing fluid entering the circulation pump, the circulation pump may run out of dishwashing fluid due to the clogging and stop operating completely. As a result, the dishwashing operation may have to be terminated prematurely due to the potential pump failure, resulting in reduced dishwashing efficiency, increasing the water and energy usage and the running cost.

With the disclosed design, the first filter screen 228A, which is positioned in a series flow configuration with the second filter screen 228B, is also configured to receive dishwashing fluid from the filtration assembly 200. Under the situation that the second filter screen 228B (the fine filter) is clogged, the dishwashing fluid may enter the filtration chamber 228 through the first filter screen 228A (coarse filter). More particularly, the recirculated dishwashing fluid may travel through either the first filter screen 228A and/or the second filter screen 228B to recirculation pump 3 via the recirculation intake port 208 and the recirculation pump inlet port 216. With such a series configuration for the filter screens instead of the conventional parallel configuration, each of the plurality of filter screens may receive a similar amount of dishwashing fluid so that the recirculation pump 3 may still receive enough filtered dishwashing fluid to maintain appropriate operation when a filter screen clogging occurs.

In some other embodiments, the filtration assembly 200 may also have an improved in-series configuration for the filter screens to mitigate the clogging issues. For example, in some embodiments, the filter frame 204 may integrally include a plurality of layers of filter screens overlapping each other thereon. In such embodiments, the plurality of layers of filter screens may be integrally coupled to the filter frame 204 in a manner that an outermost layer has a greater filtering permeability than that of an innermost layer.

In some embodiments, a drain check valve 221 may be provided in the base portion 214 of the sump housing 212 and configured to open or close the flow communication between the recirculation intake port 208 and the drainage port 218. The drain check valve 221 may be configured to open in one way to only allow the dishwashing fluid (e.g. non-filtered) and sediment accumulated in the recirculation intake port 208 of the sump housing 212 to flow into drainage port 218 and be discharged from the sump housing 212 when the drainage pump 2 is running, but prevent the flow in an opposite direction when the recirculation pump 3 is running. In some embodiments as best seen in FIGS. 3-6, the check valve 221 may be provided on the outer perimeter 234 of the recirculation intake port 208, with check valve 221 functioning as a seal by pressure when in an unactuated or sealing position when the recirculation pump 3 is running, preventing dishwashing sediment 4 within the debris collection chamber 224 from entering the recirculation pump 3 and further preventing recirculating dishwashing fluid in sump housing 212 from entering drainage pump 2. With the check valve 221, when drainage pump 2 is actuated, the dishwashing fluid (e.g. non-filtered) and any particles contained therein, may be pulled from the recirculation intake port 208. More specifically, the low pressure created by the drainage pump 2 may force the check valve 221 to open, allowing fluid and sediment within the recirculation intake port 208 to be channeled to the debris collection chamber 224 then out to a drain through the drainage port 218.

In some embodiments, the disclosed design may also include a back flush effect to help to keep the filter frame (e.g. filter screens, upstream side) clean. At one or more intervals of the wash cycle (e.g. end), the recirculation pump 3 may back flush or send/spray fluid through various conduits/channels (e.g. manifold flow path inlet, flow path(s)) to the manifold 202, or portions thereof. For example, when the recirculation pump 3 is running, the dishwashing fluid flows from the filtration assembly 200 (e.g. filtration chamber) to the spray system and/or manifold 202. In this process, the back flowing or spray of dishwashing fluid collides with the filter screens (e.g., the filter screens 228A-B, downstream side) as it back flows and through the filter screen/frame and out the upstream side 226 and/or filter frame/mesh, such that the dishwashing sediment are separated from the filter screens and flows toward the bottom of the sump housing 212 or debris collection chamber 224. Thus, the back flush of the dishwashing fluid may have a back flush effect on the filter screens to remove the attached dishwashing sediment. In some embodiments, the separated debris may fall directly into the debris collection chamber 224 and be exhausted to a drain.

As set forth above, clogging of filter components may occur in the dishwashing appliance design. Accordingly, in some embodiments, a cleaning device 300 and/or manifold 202 designed to remove sediment build-up and/or clogging of the filter screens during wash and/or drain cycles is provided. In the one embodiment shown in FIGS. 1-9, the cleaning device 300 may include one or more manifolds 202, or portions thereof. The stationary/fixed manifold 202 may be provided to remove the dishwashing sediment 4 collected on one or more of the filter screen surfaces, filter frame 204 (e.g. outer periphery), and/or upstream side 226 of the filter frame 204. The filter frame 204 may depend/project (e.g. downwardly) from the second/bottom side 202B or manifold 202 and/or may surround or be spaced outwardly from the sprayers 250 within the filtration chamber 228. The manifold 202, or portions thereof, (e.g. sprayer(s)) sprays or back flushes outwardly (e.g. radially, radially from axis R) and/or against/opposite the direction of flow into the filter frame 204/filtration chamber 228. The filter frame 204 filters dishwashing fluid inwardly (e.g. radially, radially towards the axis R) through the filter frame 204 from an upstream side 226 (e.g. first radius) to a downstream side 227 (e.g. second radius smaller than the first radius), through the mesh/screen(s). The manifold 202 and/or sprayers 250 spray or back flush the filter frame 204 outwardly (e.g. radially, radially away from the axis R) through the filter frame 204 (e.g. mesh, screen), opposite the dishwashing fluid being filtered, and/or from the downstream side 227 (e.g. second radius) to the upstream side 226 (e.g. first radius) and/or through the frame and/or mesh portions. The sprayer(s) 250 of the manifold 202 may be configured to spray debris 4 from the upstream side 226 of the filter frame 204 towards (e.g. outwardly, radially) the debris collection chamber 224 and/or upstream of the filter frame 204. The one or more sprayers 250 may spray away and/or out from (e.g. radially) the filtration chamber 228. The spray of dishwashing fluid may be in a direction upstream of the filtration chamber 228 towards the debris collection chamber 224.

In some implementations, the appliance 100, filtrations assembly 200, and/or manifold 202 may include one or more sprayers 250. In the one embodiment shown in FIGS. 1-9, the manifold 202 may include one or more sprayers 250 in communication with and/or within the filtration chamber 228. The second side 202B of the manifold 202 may include the one or more sprayers 250. The sprayer(s) 250 may be positioned downstream of the filter frame 204 and/or adjacent the downstream side 227 of the filter frame and/or internal to the filter frame 204. The one or more sprayers 250 may be positioned adjacent the top end 232 of the filter frame 204.

In some implementations, the one or more sprayers 250 may spray one or more portions (e.g. screens, sides) of the filter frame (e.g. downstream side), or portions thereof. The manifold 202 may include at least one first sprayer 250A configured to spray at least a first portion (e.g. downstream side) and/or at least one second sprayer 250B configured to spray at least a second portion (e.g. downstream side) different from the first portion. As shown in the one embodiment in FIG. 6, at least one first sprayer 250A may spray a second/bottom portion 204B and/or at least one second sprayer 250B may spray a first/top portion 204A. The top portion 204A may be adjacent the manifold 202 and/or the bottom portion 204B may be distal from the manifold 202. The first sprayer 250A may be configured to spray through the downstream side 227 to the upstream side 226 of the bottom portion 204B. The second sprayer 250B, if used, may be configured to spray through the downstream side 227 to the upstream side 226 of the top portion 204A. The first sprayer 250A may be different from the second sprayer 250B as shown in the one embodiment, however the sprayers 250 may be the same. The first, second, third, etc. filter portions may be sprayed through the filter frame and/or through/from the downstream side 227 to/out the upstream side 226 of the respective filter portion. One or more sprayers may spray one or more portions of the filter frame 204. For example, although not shown, the first sprayer may spray the top portion and the bottom portion. In other embodiments, the second sprayer may spray the top portion and the bottom portion. In some embodiments, the first prayer may spray the top portion. In other embodiments, the second sprayer may spray the bottom portion.

In some implementations, the manifold 202, filtration assembly 200, and/or appliance 100 may include one or more inlets/pathways 251 to the manifold 202 to supply dishwashing fluid to the manifold, or portions thereof (e.g. one or more flow channels/paths 252, one or more sprayers 250). Although a single manifold flow path inlet 251 is shown in the one embodiment, a plurality of inlets may supply one or more sprayers 250 and/or one or more flow channels/paths 252. In the one embodiment shown, the manifold flow path inlet 251 may supply dishwashing fluid to a first flow channel/path 252A and/or a second flow channel/path 252B.

Figure 8:
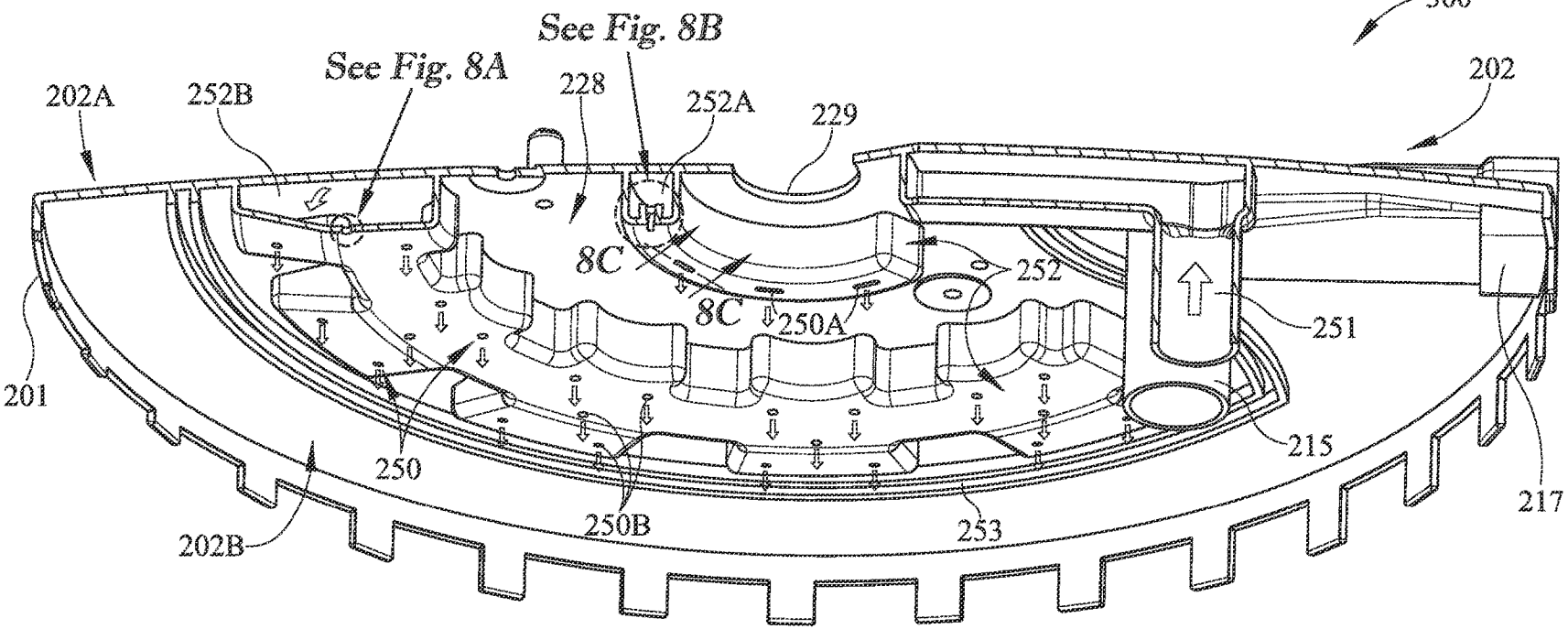
FIG. 8 is a sectional view of the manifold of FIG. 7 taken along line 8-8, according to an embodiment of the present disclosure.
Figure 8C:
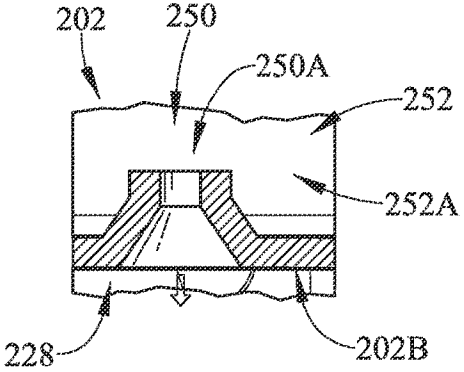
FIG. 8C is a sectional view taken along line 8C-8C of FIG. 8.
Figure 8B:
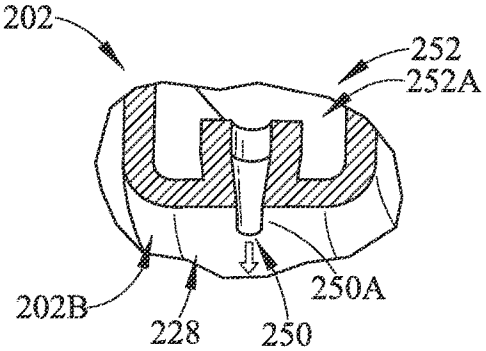
FIG. 8B is an enlarged view of the manifold of FIG. 8, illustrating the fan jet and/or first sprayer of one or more sprayers positioned along a flow path (e.g. first).
Figure 8A:
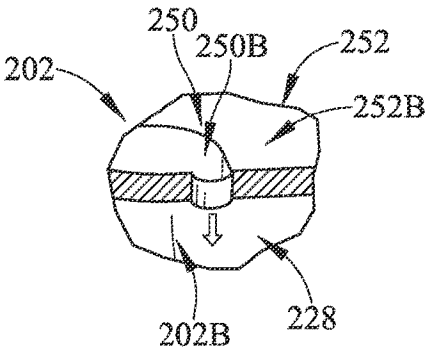
FIG. 8A is an enlarged view of the manifold of FIG. 8, illustrating the circular jet and/or second sprayer of one or more sprayers positioned along a flow path (e.g. second).
Figure 9:
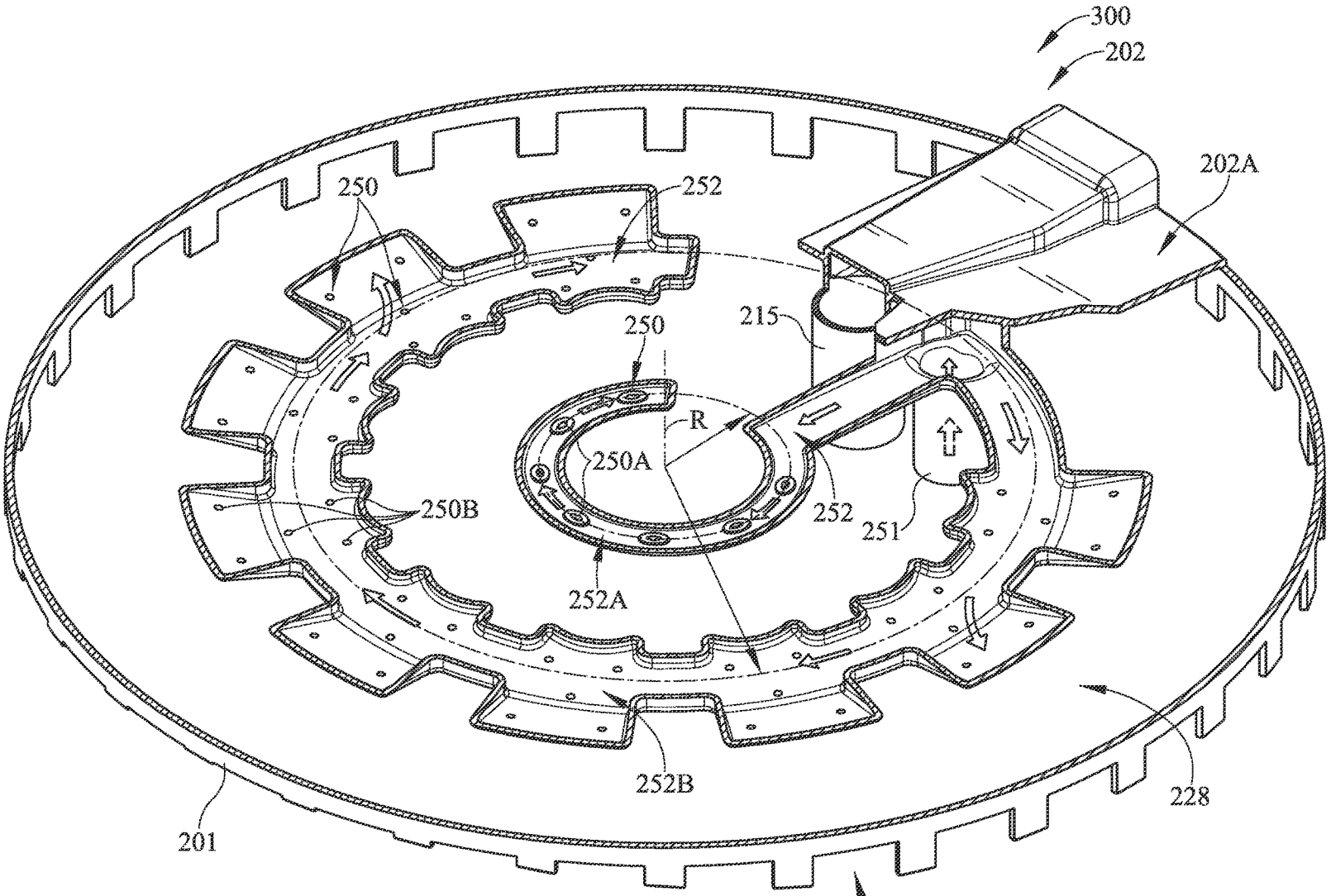
FIG. 9 is a sectional view taken along line 8-8 of the manifold of FIG. 7, according to an embodiment of the present disclosure.

In some implementations, the manifold 202, filtration assembly 200, and/or appliance 100 may include one or more flow channels 252 to supply dishwashing fluid to one or more sprayers 250 (e.g. first, second, third, etc., ports, nozzles, jets). Although the one embodiment illustrates two or more flow channels/paths 252 supplying one or more sprayers 250, the manifold may include a single flow channel 252 in some embodiments. The one or more flow paths 252 may be in fluid communication between the one or more manifold flow path inlets 251 and the one or more sprayers 250. In the one embodiment shown, the manifold 202 may include a first flow channel 252A and/or a second flow channel 252B. The two or more flow paths 252 may be spaced from (e.g. radially) each other. The flow path may be arcuate in shape. The flow paths may be radially spaced from each other and/or about the axis R. For example, as shown in the one embodiment, the first flow path 252A (e.g. outer ring) may be positioned at a larger radius relative to the second flow path 252B (e.g. inner ring) and/or radially spaced from each other. For example, the first flow path may be at a first radius and the second flow path may be at a second radius larger than the first radius. Although each flow path 252 may have a distal end that is closed, it should be understood that the flow paths may be connected adjacent the proximal end adjacent the manifold flow path inlet 251 and/or at one or more locations along the length thereof. For example, at the distal ends of the flow path. Although a plurality of flow paths may share one or more downstream sprayers, the one embodiment shown illustrates each flow path includes one or more sprayers, respectively. The first flow path 252A may include one or more first sprayers 250A. The second flow path 252B may include one or more second sprayers 250B. The first sprayer may be different or the same as the second sprayer. Although the one or more sprayers may be the same within one or more different flow paths, the one embodiment shows that the first sprayer 250A within or adjacent the first flow path 252A may be different from the second sprayer 250B within or adjacent the second flow path 252B. In the one embodiment, the one or more first sprayers 250A may be substantially the same in the first flow path 252A. Alternatively, the first sprayers may be different from each other. In the one embodiment, the one or more second sprayers 250B may be substantially the same in the second flow path 252B. Alternatively, the second sprayers may be different from each other. The one or more sprayers may be spaced about the circumference of the arcuate flow path and/or at one or more radially positions from the axis R. The sprayer and/or flow path may be a variety of positions, quantities, orientations, shapes, sizes, and/or spray patterns/directions and still be within the scope of the invention. For example as shown in FIGS. 8, 8A, and 9, at least one second sprayer 250B may be substantially circular in shape and/or may be a circular jet. Further as shown in FIGS. 8, 8B, 8C, and 9, at least one first sprayer 250A may be elongated in shape and/or a fan jet. The first sprayers 250A may be elongated and/or positioned tangent to the arcuate/flow path 252A (e.g. first). The one or more second sprayers 250B may be positioned at a larger radius and/or larger flow path than the one or more first sprayers 250A. Although other directions/angles/orientations are contemplated, the spray may be directed perpendicular/transverse to the surfaces (e.g. downstream side, openings, screen) of the filter frame 204. This may allow fluid to penetrate and/or pass through (e.g. flush) the filter frame from the downstream side to the upstream side to remove collected debris outwardly from the upstream side.

In some implementations, the recirculation pump 3 may supply dishwashing fluid to the manifold 202. The recirculation pump 3 may filter the dishwashing fluid through the filter frame 204 (e.g. from the debris collection chamber 224 to the filtration chamber 228, upstream side to the downstream side) to the recirculation pump 3 via the recirculation intake port 208 and/or the recirculation pump inlet port 216. The recirculation pump 3 may pump the dishwashing fluid into the spray system, through the manifold flow path inlet 251, and/or the manifold 202 (e.g. one or more sprayers, flow path(s)) via the recirculation pump outlet port 219. Although not shown, one or more control valves may be configured to control or direct flow to the manifold and/or spray system(s).

In use, in some implementations, the manifold 202 may be fixedly coupled to the filter. The stationary and/or non-rotating manifold 202 may include the filter frame 204 depending/projecting downwardly/away from the manifold 202, or portions thereof. The manifold 202 (e.g. second side 202B, side with sprayers 250) may define a portion (e.g. top) of the filtration chamber 228. The filter frame 204 may include the upstream side or portions 226, adjacent the debris collection chamber 224, and the downstream side or portions 227, adjacent the filtration chamber 228. One or more sprayers 250 of the manifold 202 may be positioned within the filtration chamber 228. One or more sprayers 250 of the manifold 202 may be positioned adjacent the downstream side 227 of the filter frame 204. During operation, the dishwashing fluid is filtered through the upstream side 226 to the downstream side 227 of the filter frame into the filtration chamber 228 (e.g. adjacent the downstream side), and/or away from (e.g. radially inward) the debris collection chamber 224 (e.g. adjacent to or upstream the upstream side 226. The sprayer(s) 250 of the manifold 202 spray or dispense water or dishwashing fluid into or through the downstream side 227 of the filter frame 204 to the upstream side 226 of the filter frame. The spray may flow out (e.g. radially outward) of the filtration chamber 228. The sprayed dishwashing fluid may pass/flow/back flush radially outward through the downstream side 227 to the upstream side 226 of the filter frame 204 out of the filtration chamber 228. In some embodiments, filtering dishwashing fluid may be radially inward from the debris collection chamber 224 through the upstream side 226 of the filter frame 204 to the downstream side 227 of the filter into the filtration chamber 228. The spraying (e.g. second sprayer, sprayer(s)) of the dishwashing fluid may be orientated or directed at or towards at least a first portion 204A of the filter frame. The spraying (e.g. first sprayer, sprayer(s)) of the dishwashing fluid may be orientated or directed at or towards at least a second filter portion 204B, if used, of the filter frame. The second filter portion may be lower than the first filter portion in some embodiments. In some embodiments as shown, the first sprayer 250A may be different from the second sprayer 250B. For example, different in shape, size, spray time and/or duration, position, quantity, and/or construction. In other embodiments, the first and second sprayer may be the same. The manifold may include a second sprayer 250B of the one or more sprayers positioned at a larger radius than a first sprayer 250A of the one or more sprayers in the manifold. The manifold 202 may include a first path 252A in communication with one or more sprayers (e.g. first). The manifold 202 may include a second path 252B in communication with one or more sprayers (e.g. second).

In general, it should be understood that some features described above do not constitute limitations of the present disclosure, but rather have only been described for the sake of completeness. Instead, the present disclosure is particularly directed to a dishwashing appliance 100 configuration, filtration assembly 200, and/or manifold 202. It should also be understood that the shrouded filtration assembly 200, sprayers 250, flow paths 252, inlets 251, and/or manifold 202 may be a variety of constructions, shapes, sizes, quantities, and positions but still accomplish the same intent. The shrouded filtration assembly 200 and/or manifold 202 depicted in the accompanying figures may include additional components and that some of the components described in those figures may be removed and/or modified without departing from scopes of the elements disclosed herein. The elements depicted in the figures may not be drawn to scale and thus, the elements may have different sizes and/or configurations other than as shown in the figures.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding,"

"composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A dishwashing appliance comprising:

a dishwashing tub defining a dishwashing chamber having a tub floor therein;

a manifold positioned adjacent an opening in the tub floor of the dishwashing chamber, wherein the manifold includes one or more sprayers;

a filter frame depending downwardly from the manifold, wherein the filter frame includes an upstream side and a downstream side, wherein the dishwashing fluid is filtered inwardly through the filter frame from the upstream side to the downstream side; and wherein the one or more sprayers of the manifold spray outwardly through the filter frame, opposite to the dishwashing fluid, from the downstream side to the upstream side.

2. The dishwashing appliance of claim 1 wherein the manifold includes a first flow path having at least one first sprayer of the one or more sprayers and a second flow path having at least one second sprayer of the one or more sprayers.

3. The dishwashing appliance of claim 2 wherein the at least one first sprayer is different than the at least one second sprayer.

4. The dishwashing appliance of claim 2 wherein the first flow path and the second flow path are radially spaced from each other.

5. The dishwashing appliance of claim 2 wherein the filter frame includes a bottom portion and a top portion, wherein the top portion is adjacent the manifold and the bottom portion is distal from the manifold, and wherein the at least one first sprayer is configured to spray through the downstream side to the upstream side of the bottom portion and the at least one second sprayer is configured to spray through the downstream side to the upstream side of the top portion.

6. The dishwashing appliance of claim 1 further comprising a spray system having one or more distribution devices within the dishwashing chamber;

a recirculation pump configured to flow dishwashing fluid to the spray system and the one or more sprayers of the manifold;

a drainage pump configured to flow dishwashing fluid and debris to a drainage pipe; and a sump housing having an open top portion through which the filter frame coupled, and a base portion having a recirculation intake port in fluid communication with the recirculation pump via a recirculation pump inlet port and a recirculation pump outlet port, and a debris collection chamber in fluid communication with the drainage pump and the drainage pipe via a drainage pump port and a drainage port, wherein when dishwashing fluid is extracted by the recirculation pump through the filter frame to the recirculation pump via the recirculation intake port and the recirculation pump inlet port, and into both the spray system and the one or more sprayers of the manifold via the recirculation pump outlet port therefrom.

7. The dishwashing appliance of claim 1 wherein the one or more sprayers are configured to spray debris from the upstream side of the filter frame outwardly towards a debris collection chamber.

8. The dishwashing appliance of claim 1 wherein the one or more sprayers of the manifold are downstream of the filter frame.

9. The dishwashing appliance of claim 1 further comprising a filtration assembly positioned at a bottom of the dishwashing chamber through the opening formed by the tub floor thereof, the filtration assembly comprising:

the manifold positioned at a top of the filtration assembly and above the opening of the tub floor to form a gap therebetween around a periphery of the manifold to allow the dishwashing fluid to flow into the filtration assembly, and wherein the manifold includes the one or more sprayers;

the filter frame coupled to the manifold defining a filtration chamber, the dishwashing fluid flows through the filter frame into the filtration chamber for filtration;

a sump housing having an open top through which the filter frame is disposed and a base portion having a recirculation intake port in downstream communication with the filtration chamber, and wherein the sump housing defines a debris collection chamber, the dishwashing fluid flows to the debris collection chamber outside the filtration chamber; and wherein the one or more sprayers of the manifold sprays away from the filtration chamber and in a direction upstream of the filtration chamber towards the debris collection chamber.

10. The dishwashing appliance of claim 9 further comprising a first flow path having at least one first sprayer of the one or more sprayers and a second flow path having at least one second sprayer of the one or more sprayers.

11. The dishwashing appliance of claim 10 wherein the at least one first sprayer is different than the at least one second sprayer.

12. The dishwashing appliance of claim 10 wherein the first flow path and the second flow path are radially spaced from each other.

13. The dishwashing appliance of claim 10 wherein the filter frame includes a bottom portion and a top portion, wherein the top portion is adjacent the manifold and the bottom portion is adjacent the recirculation intake port, and wherein the at least one first sprayer is configured to spray through a downstream side to an upstream side of the bottom portion and the at least one second sprayer is configured to spray through a downstream side to an upstream side of the top portion.

14. The dishwashing appliance of claim 9 wherein an outer periphery of the filter frame is spaced inwardly from an outer periphery of the manifold.

15. The dishwashing appliance of claim 1 wherein the filter frame includes at least a first filter portion above at least a second filter portion, which is configured to spray at least the second filter portion with a first sprayer of the one or more sprayers and spray at least the first filter portion with a second sprayer of the one or more sprayers different from the first sprayer.

16. The dishwashing appliance of claim 1 wherein the manifold includes a first path in communication with a first sprayer of the one or more sprayers and a second path in communication with a second sprayer of the one or more sprayers.

17. The dishwashing appliance of claim 1 wherein the manifold includes a second sprayer of the one or more sprayers positioned at a larger radius than a first sprayer of the one or more sprayers in the manifold.

* * * * *